US006765136B2

(12) United States Patent
Van Pamel

(10) Patent No.: US 6,765,136 B2
(45) Date of Patent: Jul. 20, 2004

(54) HYDROPHOBIC POLYMER STRING TREATMENT

(75) Inventor: Kevin S. Van Pamel, Geneva, IL (US)

(73) Assignee: Gibson Guitar Corp., Nashville, TN (US)

( * ) Notice: Subject to any disclaimer, the term of this patent is extended or adjusted under 35 U.S.C. 154(b) by 23 days.

(21) Appl. No.: 10/338,805

(22) Filed: Jan. 8, 2003

(65) Prior Publication Data

US 2003/0183061 A1 Oct. 2, 2003

Related U.S. Application Data

(60) Provisional application No. 60/349,614, filed on Jan. 16, 2002.

(51) Int. Cl.[7] ..... G10D 3/00
(52) U.S. Cl. ..... 84/297 R
(58) Field of Search ..... 84/297 R

(56) References Cited

U.S. PATENT DOCUMENTS

| | | | | |
|---|---|---|---|---|
| 3,826,171 A | | 7/1974 | Kear | 84/297 |
| 3,953,566 A | | 4/1976 | Gore | 264/288 |
| 3,962,153 A | | 6/1976 | Gore | 260/2.5 R |
| 4,096,227 A | | 6/1978 | Gore | 264/210 R |
| 4,187,390 A | | 2/1980 | Gore | 174/102 R |
| 4,326,444 A | | 4/1982 | Markley | 84/297 |
| 4,339,499 A | | 7/1982 | Tappe et al. | 428/373 |
| 4,382,358 A | * | 5/1983 | Tappe et al. | 57/243 |
| 4,383,465 A | | 5/1983 | Conklin, Jr. | 84/199 |
| 4,539,228 A | | 9/1985 | Lazarus | 427/180 |
| 4,750,397 A | * | 6/1988 | Ashworth-Jones | 84/731 |
| 5,009,142 A | | 4/1991 | Kurtz | 84/454 |
| 5,107,852 A | | 4/1992 | Davidson et al. | 128/772 |
| 5,535,658 A | | 7/1996 | Kalosdian | 84/297 |
| 5,610,348 A | | 3/1997 | Aladin | 84/297 |
| 5,801,319 A | | 9/1998 | Hebestreit et al. | 84/297 |
| 5,883,319 A | | 3/1999 | Hebestreit et al. | 84/297 |
| 5,907,113 A | | 5/1999 | Hebestreit et al. | 84/297 |
| 6,248,942 B1 | | 6/2001 | Hebestreit et al. | 84/297 |
| 6,280,517 B1 | | 8/2001 | Ogawa | 106/287.1 |
| 6,528,709 B2 | | 3/2003 | Hebestreit et al. | 84/297 |

FOREIGN PATENT DOCUMENTS

| | | |
|---|---|---|
| DE | 963830 | 5/1957 |
| DE | 3133231 A | 3/1983 |
| DE | 3326006 | 1/1985 |
| DE | 4109334 A1 | 11/1992 |
| GB | 690031 A | 4/1953 |
| GB | 2187217 | 9/1987 |
| JP | 63182441 | 7/1988 |
| JP | 88057799 | 11/1988 |
| WO | 9001766 | 2/1990 |

OTHER PUBLICATIONS

Acoustic Guitar, Oct. 1996, pp. 66–73, article re guitar strings.
KAMAN Music Reference Manual & Music Products Catalog, 1994, GLOSSARY "String Composition" p. 67.
KAMAN Music Reference Manual & Music Products Catalog, 1994, "Strings (Fretted Instruments)" p. 78.

* cited by examiner

*Primary Examiner*—Kimberly Lockett
(74) *Attorney, Agent, or Firm*—Waddey & Patterson; Lucian Wayne Beavers; Howard H. Bayless

(57) ABSTRACT

A hydrophobic polymer is adhesively coated on the surfaces of the wound string within its interstitial voids, while the exterior surfaces remain uncoated. The polymer is applied by soaking the string in a liquid polymeric solution to flow the solution into the interstitial voids. The string is removed from the bath and the residual solution is removed from the exterior surface of the string using a resilient scraper. The string is hung to dry for 8 hours in a clean room environment at ambient temperatures and, more preferably, maintained at a temperature of between 20° C. and 25° C. Alternatively, the string is treated by a combination of heat and drying.

44 Claims, 2 Drawing Sheets

HYDROPHOBIC POLYMER STRING TREATMENT

This application claims the priority benefits under Title 35, United States Code, §119(e) of U.S. Provisional Application Serial No. 60/349,614 filed on Jan. 16, 2002.

BACKGROUND OF THE INVENTION

The present invention relates generally to wound wires and the polymeric treatment thereof, and more particularly, but not by way of limitation, to wound musical instrument strings and the hydrophobic polymeric treatment thereof. As used in this disclosure, the term wire includes metal and non-metal wires, strings, ropes, cords, filaments and other similar structures.

One traditional design for a musical instrument string is to have an axial core wire around which is wrapped a wrap wire to add mass to the string. Such strings are commonly used for guitars and are referred to as wound strings. When mounted and tensioned on a musical instrument, the acoustic qualities of an oscillating wound string depends on, among other features, the degree of freedom of movement the windings of the wrap wire have in sliding over the core wire and in sliding relative to adjacent windings. In order to have the designed amount of free movement, any friction or adhesion of the windings and the core wire must be minimized. To this end, designers of wound musical strings frequently select polished metal wires for the wrap wire and core wire because components made of such materials have smooth surfaces and low coefficients of friction.

However, musicians have frequently encountered one difficulty in the use of such wound strings. The sound quality deteriorates rapidly as a string is played. The useful life of a conventional wound string is much less that of a similar non-wound musical string. The problem is caused by the environment in which the string is used. Musicians' hands convey moisture, water soluble acids and salts, skin particles and other debris to the surface of the wound string as it is being oscillated. This moisture, acids, salts and debris collects in the interstitial gaps and voids between adjacent windings and between the windings and the core wire. The moisture, acids and salts causes corrosion of the component surfaces of the wound string, while the debris mechanically interferes with the movement of the windings. Corrosion creates microscopic fissures in the surface of the wrap wire and core wire. These fissures significantly increase the resistance to free movement of the windings of the wound string. The acoustic effects vary, but include a deadening of the sound of the string and a frequent need to retune or replace the string. Thus, wound strings may have a relatively short playing life during which they provide the optimum sound.

Over the years a number of solutions have been suggested for this problem. For example, U.S. Pat. No. 4,539,228 to Lazarus discloses a treatment for wound strings. In the process disclosed in Lazarus, the microscopic pores, cavities and crevices of the surfaces of a wound string are filled with polymeric micro-particles which act as a dry lubricant by reducing the friction between the surfaces of the string. The suspended dry lubricant is conveyed into the interstitial gaps and voids in a solvent emulsification containing: the suspended dry lubricant particles, a carrier solvent, a moisture displacing agent and a rust inhibiting agent. Depending on the formulation, the carrier solvent may be a moisture displacing agent or a rust inhibiting agent. The string is soaked in the solvent emulsification for an extended time to allow the carrier solvent to flow the suspended dry lubricant particles into the various pores of the material and into the interstitial cavities of the wound string. The dry lubricant particles provide lubrication and moisture displacing agent and rust inhibitor limit the corrosion of the string, thus extending its life according to the disclosure. The disadvantage of the Lazarus method is that the liquid moisture displacing agent or rust inhibiting agent may flow out of the interstitial void or may soon be exhausted.

Other solutions are directed toward preventing moisture and solid debris from collecting in the interstitial gaps and voids between adjacent windings and between the windings and the core wire. One such solution that is currently used by some string companies is to coat the outer surface of the wound string with an impermeable barrier. For instance, the D'Addario String Company soaks its strings in lacquer then dries them in air, thus providing a fully lacquer coated wound string. A similar string is offered by Martin Guitar Company. The disadvantage of lacquer coated wound strings is that the exterior coating wears quickly and is susceptible to cracking.

Still another approach is that used by W. L. Gore and Associates, Inc. for its Elixir brand strings. The Elixir brand strings are wound with a TEFLON® film which covers the string. The Elixir technology is described in U.S. Pat. Nos. 5,883,319; 5,801,319; 5,907,113 and 6,248,942. The Elixir process involves a complex manufacturing process first requiring the manufacture of the TEFLON film and then the wrapping and adhesion of the film to the wound strings. Additionally, such film may cause the acoustic quality of the wound string to be deadened.

Accordingly, there is a continuing need in the arts for an economical and procedurally simple solution to the problem of preventing moisture, acid and salts from causing corrosion of the windings and the core wire, and to the problem of solid debris collecting in the interstitial voids between the windings and the core wire.

SUMMARY OF THE INVENTION

A hydrophobic polymeric material is coated on the surfaces of the wound string within the interstitial voids between the string windings and between the winding and the core wire, while the exterior surfaces remain uncoated. The hydrophobic polymer prevents or reduces corrosion by repelling moisture and by forming barriers to the introduction of moisture and debris into the interstitial voids. The polymer is applied by soaking the majority of the length of the string in a liquid polymeric solution, situated in a holding tank, for a time sufficient to allow for proper penetration of the solution into the interstitial voids. The string is removed from the bath. The residual liquid polymeric solution is removed from the exterior surface of the wound string by use of a resilient scraper. The string is hung to dry for 8 hours in a clean room environment at ambient temperatures and, more preferably, maintained at a temperature of between 20° C. and 25° C. Alternatively, the string is treated by a combination of heat and drying. The end result is a string whose tonal quality and useful life is extended.

Accordingly, it is an object of the present invention to provide an improved treatment for wound strings which will protect the string from the corrosion caused by the accumulation of moisture, acids and salts in the interstitial gaps and voids between adjacent windings and between the windings and the core wire.

Another object of the invention is the provision of a string treatment process which will reduce the accumulation of moisture, acids and salts and solid debris in the interstitial gaps and voids between adjacent windings and between the windings and the core wire.

Another object of the invention is the provision of a string treatment process which is simple to apply.

Another object of the present invention is the provision of economical processes for treatment of wound strings.

Other and further objects features and advantages of the present invention will be readily apparent to those skilled in the art upon a reading of the following disclosure when taken in conjunction with the accompanying drawings.

BRIEF DESCRIPTION OF THE DRAWINGS

FIG. 3 shows a string located above the reservoir of liquid polymeric solution, prior to placement of the untreated wound string in the reservoir.

FIG. 4 shows the string immersed in the liquid polymeric solution.

FIG. 5 shows the string being drawn through a resilient scraper to remove excess liquid polymeric solution, which is returned to the reservoir.

FIG. 6 shows an alternative horizontal reservoir.

DESCRIPTION OF THE PREFERRED EMBODIMENTS

Figure 1:
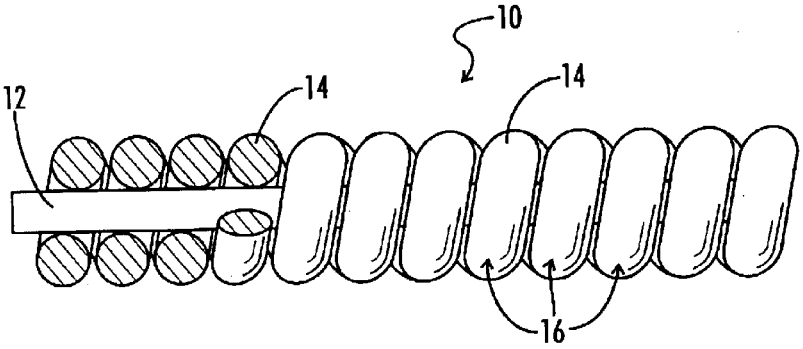
FIG. 1 is a partially sectioned view of a wound string in accordance with the present invention.

Referring now to FIG. 1, a wound musical instrument string constructed in accordance with the present invention is shown and generally designated by the numeral 10. The wound string 10 contains a core wire 12 and a wrap wire 14, which is wrapped in helical windings 16 around the core wire 12 along the majority of the length of the core wire 12. Each winding 16 of the wrap wire 14 is in contact with the adjacent windings 16 and in contact with the core wire 12. The core wire 12 of the string can be of any suitable material. Materials commonly used for the core wire include, but are not limited to, ductile metals, nylon and silk. Similarly, the wrap wire 14 can be of any suitable material. Materials commonly used for the wrap wire include, but are not limited to, ductile metals. Steel alloys and nickel alloys are frequently selected for either or both wires. Electroplating of one or both the core and wrap wires with gold or other suitable ductile, corrosion resistant metal is also a common practice.

The topology of the wrap wire's helical windings 16 and the core wire 12 create a series of voids and gaps disposed between the convoluted surfaces of the wound string 10. Because there is no well defined limit to the voids and gaps, a convention is adopted by this disclosure wherein the interior surface 36 of the wound string 10 is such portions of the wrap wire surface 32 and of the core wire surface 30 as are not readily exposed to direct contact with objects used to play the wound string 10. Objects contemplated as being used to play the wound string 10 would include a musicians hands and fingers, a pick and a bow. The exterior surface 34 of the wound string 10 would comprise the remainder of the surfaces.

Figure 2A:
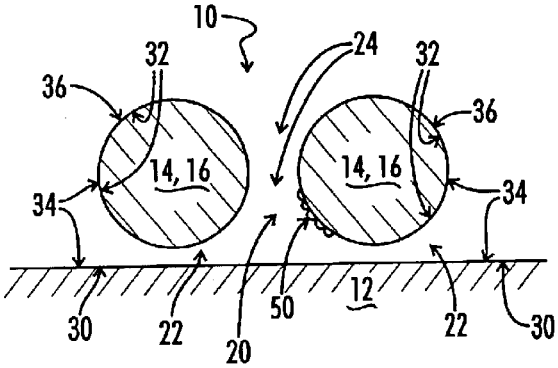
FIGS. 2A–2C are partially sectioned views of the wound string of FIG. 1 illustrating the wrap wire windings and the core wire, the interstitial gaps and voids of the wound string, and the polymer material disposed in those gaps and voids.

These voids and gaps shift somewhat in position, size and shape as the windings 16 move in relation to the core wire 12 and in relation to adjacent windings 16. Referring now to FIG. 2A, taken together, the above described voids and gaps are termed the interstitial voids 20. FIG. 2A is a cross-sectional detail view of the wound string 10 illustrating the juxtaposition of the circular cross-sections of two adjacent windings 16 with each other and with the edge of the half-planar cross-section of the core wire 12. The interstitial voids 20 have two types of sub-regions illustrated. Winding-winding gaps 24 are defined by the surfaces of adjacent windings 16 and illustrated in FIG. 2A by the double convex region on either side of the closest point of approach of one circular cross-section of adjacent windings 16 with the other. It is understood that the shape and size of such winding-winding gaps 24 change as the wound string 10 oscillates. The surfaces of adjacent windings 16 move from actually touching to wider openings than present in non-oscillating conditions. Similarly the surfaces of the windings 16 and the core wire 12 define winding-core gaps 22 and are illustrated in FIG. 2A by the single convex region on either side of the closet point of approach of the circular cross-section of the winding 16 with the edge of the half planar cross-section of the core wire 12. The winding-core gaps 22 shift in position as the windings 16 slide back and forth along the core wire 12 during oscillation.

Figure 2B:
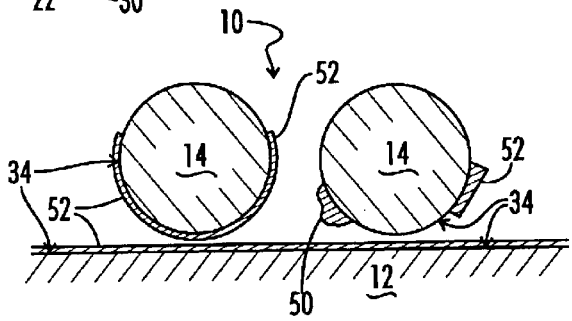
Figure 2C:
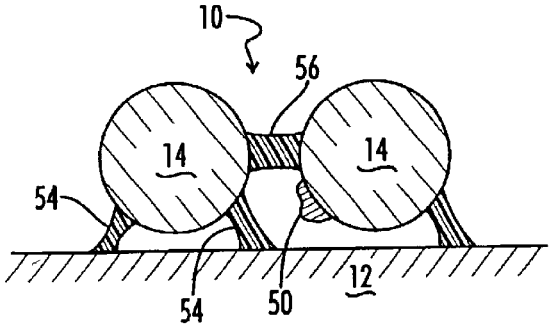

Referring now to FIGS. 2B–2C, the invention further includes a hydrophobic polymeric material 50 disposed in the interstitial voids 20. In FIG. 2B the hydrophobic polymeric material 50 is illustrated as adhered to the interior surface 34 of the wound string 10. As described below in the method of manufacture of this invention, in this described embodiment the hydrophobic polymeric material 50 is the chemical product of a polymeric solute dissolved in a liquid polymeric solution.

One liquid polymeric solution which has been found suitable for the present invention is the FluroPel brand fluroaliphatic polymer in a fluorosolvent polymer from Cytonix Corporation, 8000 Virginia Manor Road, Beltsville, Md. 20705. FluoroPel polymers are hydrophobic polymers that have low surface energies, low biomolecular absorption and sheds organic solvents. Any polymer that is hydrophobic, is pliable and non-hazardous to the touch could also be suitably used. Although destructive testing has not been performed to analyze the distribution of the hydrophobic polymeric material 50 within the interstitial voids 20, it is believed that the FluroPel liquid polymeric solution reacts with the surfaces of the wound string 10 as is otherwise well understood in other manufacturing processes using FluroPel or other suitable liquid polymeric solutions.

Referring again to FIG. 2B, the hydrophobic polymeric material 50 is shown as adhered to the interior surface 34 of the wound string 10. In areas where adhered in cohesive coatings 52, the hydrophobic polymeric material 50 forms barriers that repel water and prevent water and water soluble acids and salts from reaching the those coated surfaces of the windings 16 or core wire 12. Any adhering polymer having an average surface energy of no more than 24 dynes/cm would be sufficiently hydrophobic to be satisfactory. In this embodiment, the hydrophobic polymeric material 50 has a surface energy of no more than 10 dynes/cm and is quite effective in repelling moisture. Additionally, the hydrophobic polymeric material 50 of this embodiment has an average thickness of 1 micron or more, and more preferably an average thickness between 3 and 6 microns. Other suitable hydrophobic polymeric materials 50 may be chosen that form cohesive, durable hydrophobic coatings 52 at thickness either greater or less than that of this embodiment. The cohesiveness of a coating of hydrophobic polymeric material 50 is believed to be enhanced by at least some cross-linking of polymers. The hydrophobic polymeric material 50 of this embodiment has at least 5%, by weight, cross-linked polymeric material.

It is also believed, based on the well understood nature of the liquid solvent used, that the hydrophobic polymeric material 50 is covalently bonded to the interior surface 34 of the wound string 10. In particular, the hydrophobic polymer of the FluroPel liquid solution reacts with the various metal oxides that would be present on the surface of a metal or metal alloy. It is believed that the materials used to make the core wire 12 or wrap wire 14 would contain at least one species of oxides of iron, nickel, gold, copper, zinc or aluminum. Numerous other hydrophobic polymeric materials also undergo linkage reactions which result in covalent bonding with oxides of iron, nickel, gold, copper, zinc or aluminum and may be substituted for the hydrophobic polymeric material 50 of this embodiment of the present invention.

The present invention may also benefit from the formation of resilient barriers of the hydrophobic polymeric material 50 which prevent moisture and debris from entering the interstitial voids 20 and thus contributes to the prevention of corrosion. It is believed that in this embodiment of the invention, resilient barriers would be of secondary importance when compared to the effectiveness of the hydrophobic coatings in preventing corrosion. However, in other embodiments, resilient barriers alone may be sufficient to prevent or reduce corrosion of a wound string 10.

The hydrophobic polymeric material 50 of this embodiment is also an elastomer. When disposed in the interstitial voids, as in the method of manufacturing as described below, the hydrophobic elastomeric polymeric material 50 is believed to form resilient barriers across gaps of the interstitial voids 20. Referring now to FIG. 2C, hydrophobic elastomeric polymeric material 50 shown is disposed so as to form a winding-core barrier 54 across the winding-core gap 22 and, similarly, as to form a winding-winding barrier 56 across the winding-core gap 24. As described below, the hydrophobic elastomeric polymeric material 50 of this embodiment is disposed in the interstitial voids using either a 2% or a 4% by weight solute to solvent liquid polymeric solution. It is believed that increasing the weight percentage to 10% would more readily form barriers, especially winding-winding barriers 56. Numerous elastomeric polymeric solutions could be substituted for the FluroPel liquid polymeric solution to establish effective resilient barriers.

Referring now to FIGS. 3–6, in the methods of manufacturing the wound string 10 will be further described.

Figure 3:
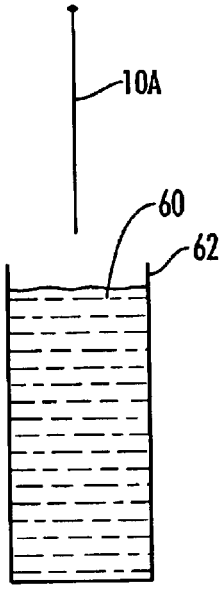
FIGS. 3–6 are a sequential series of drawings schematically illustrating the process of manufacturing the treated wound string of the present invention.

In FIG. 3, an untreated wound string 10A comprising a core wire 12 and a wrap wire 14 as described above is suspended above a bath of liquid polymeric solution 60 which is contained within a reservoir 62. The liquid polymeric solution 60 comprises a solvent and a dissolved polymeric solute. The polymeric solute may comprise monomers, polymers or copolymers, or a combination thereof. However, the end product shall comprise a hydrophobic polymeric material 50. The solvent typically is a non-aqueous solvent. In this embodiment of the invention, the solvent is a fluorinated solvent. In this embodiment the liquid polymeric solution 60 is an at least 2% by weight, and more preferably at least 4%, solution of fluroaliphatic polymer solute.

Figure 4:
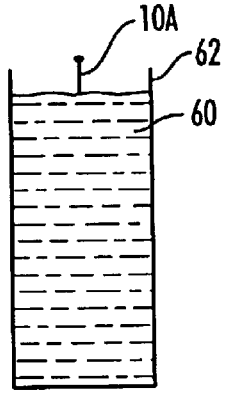

In FIG. 4, the majority of the length of the untreated wound string 10A is immersed in the bath of liquid polymeric solution 60 and allowed to soak for a period of time to enable penetration of the winding-winding gaps 24 and the deposition of the liquid polymeric solution 60 in the interstitial voids 20. In this embodiment, the string is allowed to sit for at least 10 seconds and more preferably for approximately 15 seconds. The soak time is determined by the viscosity of the liquid polymeric solution 60, the width of the winding-winding gaps 24. Flexing the untreated wound string 10A while in the bath so as to open the winding-winging gaps 24 may reduce the soak time. It is also well known in the arts to conduct the soak while subjecting the bath and string to low pressure conditions. This causes air in the interstitial voids to be more readily displaced.

Figure 5:
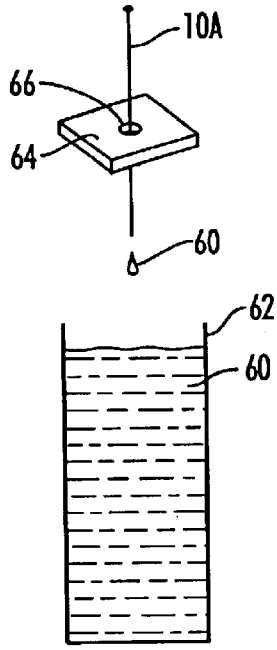

In FIG. 5, the untreated wound string 10 A is removed from the bath of resin and any remaining liquid polymeric solution 60 is removed from the surface. In this embodiment, wiping is the preferred method of removing residual solution, although other methods such using forced air or a second bath in a rinse solvent may be obvious substitutions. In this embodiment, wiping is accomplished by forcing the untreated wound string 10A against a wiping edge, such as the edge of a resilient scraper. In this embodiment, the untreated wound string 10A is forced through an opening 66, preferably circular, in a sheet of resilient material 64, such as squeegee material. The opening 66 closes snugly upon the untreated wound wire 10A and the wire is pulled through to clean the liquid polymeric solution 60 off the exterior surface 36 of the untreated wound wire 10A. The liquid polymeric solution 60 so removed may be recovered and reused. The liquid polymeric solution 60 remains in the interstitial voids 20. It is not required that all the volume of the interstitial voids 20 be completely filled, but the more volume that is filled, the better the wound string 10 will be protected against wear.

Figure 6:
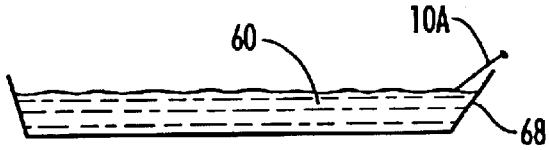

Alternatively, FIG. 6 shows a shallow tray reservoir 68 containing the liquid polymeric solution 60. The untreated wound string 10A may be laid in the shallow bath and soaked as above. The untreated wound string 10A may then picked up and drawn through the resilient scraper in a manner similar to that shown in FIG. 5.

After the excess liquid polymeric solution 60 is removed as shown in FIG. 5, the untreated wound string 10A is treated so as to form a hydrophobic polymeric material 50 from the liquid polymeric solution 60 remaining in the interstitial voids 20. In this embodiment, the treatment causes the monomers in the liquid polymeric solution 60 to undergo a condensation synthesis reaction. The treatment also causes the adhesion of the hydrophobic polymeric material 50 to the interior surface 34 of the wound string 10. In this embodiment, such adhesion is believed to be caused by covalent linkages between the polymer and metal oxides present in the alloys of the wound string 10.

The FluroPel liquid polymeric solution 60 can be treated in environment of between 20° C. and 150° C. In this embodiment, the untreated wound strings 10A are hung to dry for at least 8 hours in a clean room environment maintained at ambient temperatures, and, more preferably, maintained at a temperature of between 20° C. and 25° C. Since normal environmental temperatures are approximately 20° C., heating is not required to treat the FluroPel solution. However, if shorter treatment times are desired, it is believed that significantly shorter treatment times can be achieved by heating the clean room to maintain an environmental temperature of between 70° C. and 90° C. Other hydrophobic polymeric solutions may require different treatment temperatures and drying times.

The end result of these methods of manufacturing is a wound string 10 as shown in FIG. 1 which is resistant to corrosion and whose usable life is extended. Through the application of such hydrophobic polymers into the winding gaps of a wound string, the life of the string is extended without significant effect to the natural tone of the string. Unlike a coated string such as that sold by D'Addario and Martin, or a wrapped covered string such as the Elixir string, the protective material in the case of the present invention is adhered to the interior surfaces 34 of the wound string 10 within the interstitial voids 20 while the exterior surface 36 of the wound string 10 remains untreated. Unlike the treatment of Lazarus, the treatment of the present invention adheres a hydrophobic coating to repel moisture and water soluble corrosive agents. This protects the windings and the core wire from corrosion and from exposure to moisture, dirt and other contaminants that shorten the life of a conventional wound string.

Thus it is seen that the present invention readily achieves the ends and advantages mentioned as well as those inherent therein. While certain preferred embodiments of the invention have been illustrated and described for purposes of the present disclosure, numerous changes in parts and steps may be made by those skilled in the art, which changes are encompassed within the scope and spirit of the present invention as defined by the appended claims.

Thus, although there have been described particular embodiments of the present invention of a new and useful Hydrophobic Polymeric String Treatment, it is not intended that such references be construed as limitations upon the scope of this invention except as set forth in the following claims.

What is claimed is:

1. A musical instrument string comprising:

a core wire having a core wire surface;

a wrap wire having a wrap wire surface and wrapped in helical windings around the core wire along a majority of the length of the core wire, each of said windings being in contact with adjacent windings;

an interior surface of the string, such interior surface defined by such portions of the wrap wire surface and of the core wire surface as are shielded from direct contact with objects used to play the string; and a hydrophobic polymeric material adhered to the interior surface.

2. The string of claim 1 wherein the hydrophobic polymeric material has an average surface energy of no more than 24 dynes/cm.

3. The string of claim 2 wherein the hydrophobic polymeric material has an average surface energy of no more than 10 dynes/cm.

4. The string of claim 1 wherein the hydrophobic polymeric material comprises at least one cohesive coating adhered to the interior surface.

5. The string of claim 4 wherein the hydrophobic polymeric material comprises a cross-linked polymeric material.

6. The string of claim 4 wherein the hydrophobic polymeric material comprises a polymeric material covalently bonded to the interior surface.

7. The string of claim 6 wherein the interior surface comprises oxides of metals selected from the group consisting of iron, nickel, gold, copper, zinc and aluminum, and wherein the polymeric material covalently bonded to the interior surface is so covalently bonded via reactions with said metal oxides.

8. The string of claim 1 wherein the hydrophobic polymeric material further comprises a hydrophobic elastomeric polymeric material.

9. The string of claim 8 further comprising:

at least two interstitial voids, said interstitial voids defined between the wrap wire surface and the core wire surface, comprising:

(a) at least two winding-core gaps defined between the windings and the core wire;

(b) at least two winding-winding gaps defined between the windings and adjacent windings; and a hydrophobic elastomeric polymeric material disposed in the interstitial voids.

10. The string of claim 9 wherein the hydrophobic elastomeric polymeric material is disposed in the interstitial gaps so as to form barriers disposed across the winding-core gaps.

11. The string of claim 9 wherein the hydrophobic elastomeric polymer material is disposed in the interstitial gaps so as to form barriers disposed across the winding-winding gaps.

12. The string of claim 1 wherein the core wire comprises a ductile metal wire.

13. The string of claim 1 wherein the core wire comprises a nylon wire.

14. The string of claim 1 wherein the wrap wire comprises a ductile metal wire.

15. A process of manufacturing a musical instrument string comprising:

(a) providing a wound musical string comprising:

a core wire having a core wire surface;

a wrap wire having a wrap wire surface and wrapped in helical windings around the core wire along a majority of the length of the core wire, each said windings being in contact with adjacent windings;

an interior surface of the string, such interior surface defined by such portions of the wrap wire surface and of the core wire surface as are not readily accessible to direct contact with objects used to play the string;

an exterior surface of the string, such exterior surface defined by such portions of the wrap wire surface as are readily accessible to direct contact with objects used to play the string; and at least two interstitial voids defined between the wrap wire and the core wire, said interstitial voids comprising:

at least two winding-core gaps defined between the windings and the core wire; and at least two winding-winding gaps defined between the windings and adjacent windings;

(b) immersing the majority of the length of the string in a bath of a liquid polymeric solution, said polymer solution having a solvent and having a polymeric solute, said polymeric solute having as a chemical end product a hydrophobic polymeric material;

(c) maintaining the string in the bath for a sufficient time that the liquid polymeric solution flows into the majority of the interstitial voids;

(d) removing the string from the bath;

(e) removing any remaining liquid polymeric solution from the exterior surface of the string, so that the liquid polymeric solution remains in the interstitial voids; and (f) treating the liquid polymeric solution remaining in the interstitial voids so as to form a hydrophobic polymeric material disposed in the interstitial voids.

16. The process of claim 15 wherein step (f) comprises forming a hydrophobic polymeric material adhered to the interior surface.

17. The process of claim 16 wherein the hydrophobic polymeric material adhered to the interior surface comprises an at least one cohesive coating.

18. The process of claim 16 wherein step (f) comprises treating the liquid polymeric solution so as to undergo a condensation synthesis to form a hydrophobic polymeric material adhered to the interior surface.

19. The process of claim 16 wherein step (f) further comprises forming a cross-linked hydrophobic polymeric material.

20. The process of claim 16 wherein the hydrophobic polymeric material has an average surface energy of no more than 24 dynes/cm.

21. The process of claim 16 wherein the hydrophobic polymeric material has an average surface energy of no more than 10 dynes/cm.

22. The process of claim 16 wherein the hydrophobic polymeric material comprises polymeric material covalently bonded to the interior surface.

23. The process of claim 22 wherein the interior surface comprises oxides of metals selected from the group consisting of iron, nickel, gold, copper, zinc and aluminum, and wherein the polymeric material covalently bonded to the interior surface is so covalently bonded via reactions with said metal oxides.

24. The process of claim 15 wherein the liquid polymeric solution comprises an at least 2% by weight solution of fluroaliphatic polymer solute.

25. The process of claim 15 wherein the liquid polymeric solution comprises an at least 4% by weight solution of fluroaliphatic polymer solute.

26. The process of claim 15 wherein the liquid polymeric solution comprises a non-aqueous solvent.

27. The process of claim 15 wherein the liquid polymeric solution comprises a fluorinated solvent.

28. The process of claim 15 wherein step (c) comprises maintaining the string in the bath of liquid polymeric solution for at least 15 seconds.

29. The process of claim 15 wherein step (e) comprises wiping any remaining liquid polymeric solution from the exterior surfaces of the string.

30. The process of claim 29 wherein step (e) further comprises forcing the string against an edge of a resilient scraper.

31. The process of claim 30 wherein step (e) further comprises forcing the string through an opening in a sheet of a resilient material, said opening sized to squeeze against the exterior surface of the string.

32. The process of claim 15 wherein step (f) comprises drying the string.

33. The process of claim 15 wherein step (f) comprises heating and drying the string.

34. The process of claim 15 wherein step (f) comprises heating the string.

35. The process of claim 15 wherein step (f) comprises heating the string so as to maintain a temperature of between 20° C. and 150° C.

36. The process of claim 15 wherein the hydrophobic polymer material is a hydrophobic elastomeric polymer material.

37. The process of claim 36 wherein the hydrophobic elastomeric polymer material is disposed in the interstitial voids so as to form barriers disposed across the winding-core gaps.

38. The process of claim 37 wherein the hydrophobic elastomeric polymer material is disposed in the interstitial voids so as to form barriers disposed across the winding-winding gaps.

39. The process of claim 15 wherein the core wire is a ductile metal wire.

40. The process of claim 15 wherein the wrap wire is a ductile metal wire.

41. A process of manufacturing a musical instrument string comprising:

(a) providing a wound musical string comprising:
- a core wire comprised of ductile metal and having a core wire surface;
- a wrap wire comprised of ductile metal and having a wrap wire surface, said wrap wire wrapped in helical windings around the core wire along a majority of the length of the core wire, each said windings being in contact with adjacent windings;
- an exterior surface of the string, such exterior surface defined by such portions of the wrap wire surface as are readily accessible to direct contact with objects used to play the string; and
- at least two interstitial voids defined between the wrap wire and the core wire, said interstitial voids comprising:
  - at least two winding-core gaps defined between the windings and the core wire; and
  - at least two winding-winding gaps defined between the windings and adjacent windings;

(b) immersing the majority of the length of the string in a bath of a liquefied elastomeric polymeric material;

(c) maintaining the string in the bath for a sufficient time that the liquefied elastomeric polymeric material flows into the majority of the interstitial voids;

(d) removing the string from the bath;

(e) removing any remaining liquefied elastomeric polymeric material from the exterior surface of the string, so that the liquid polymeric solution remains in the interstitial voids; and (f) treating the liquefied elastomeric polymeric material remaining in the interstitial voids so as to form a cohesive elastomeric polymeric material disposed in the interstitial voids.

42. The process of claim 41 wherein the cohesive elastomeric polymer material comprises a hydrophobic elastomeric polymer material.

43. The process of claim 41 wherein the elastomeric polymer material is disposed in the interstitial voids so as to form barriers disposed across the winding-core gaps.

44. The process of claim 41 wherein the elastomeric polymer material is disposed in the interstitial voids so as to form barriers disposed across the winding-winding gaps.

* * * * *